US005096180A

United States Patent [19]

Nagaoka et al.

[11] Patent Number: 5,096,180

[45] Date of Patent: Mar. 17, 1992

[54] IMAGE RECORDING APPARATUS WITH THE ABILITY TO DETERMINE IF ENOUGH EXPENDABLE SUPPLIES ARE AVAILABLE TO CARRY OUT A RECORDING JOB

[75] Inventors: Daiji Nagaoka; Hiroshi Saito, both of Kanagawa, Japan

[73] Assignee: Fuji Xerox Co., Ltd., Tokyo, Japan

[21] Appl. No.: 595,444

[22] Filed: Oct. 10, 1990

[51] Int. Cl.[5] ..... B65H 7/04

[52] U.S. Cl. ..... 271/110; 271/3.1; 271/145

[58] Field of Search ..... 271/3.1, 110, 111, 127, 271/145, 258, 265

[56] References Cited

U.S. PATENT DOCUMENTS

| | | | |
|---|---|---|---|
| 4,568,172 | 2/1986 | Acquaviva | 271/3.1 |
| 4,579,326 | 4/1986 | Pinckney et al. | 271/3.1 |
| 4,611,800 | 9/1986 | Parsons et al. | 271/3.1 |
| 4,815,725 | 3/1989 | Kanaya | 271/258 |
| 4,888,617 | 12/1989 | Okuzawa | 271/110 |

FOREIGN PATENT DOCUMENTS

| | | | |
|---|---|---|---|
| 3616509 | 11/1986 | Fed. Rep. of Germany | 271/258 |
| 184039 | 11/1982 | Japan | 271/145 |
| 63637 | 4/1983 | Japan | 271/258 |
| 153742 | 9/1984 | Japan | 271/145 |
| 230934 | 12/1984 | Japan | 271/258 |
| 52440 | 3/1985 | Japan | 271/258 |
| 102336 | 6/1985 | Japan | 271/145 |
| 244718 | 12/1985 | Japan | 271/145 |
| 2640 | 1/1986 | Japan | 271/265 |
| 2641 | 1/1986 | Japan | 271/110 |
| 197345 | 9/1986 | Japan | 271/265 |
| 235336 | 10/1986 | Japan | 271/258 |
| 249849 | 10/1987 | Japan | 271/111 |
| 57445 | 3/1988 | Japan | 271/258 |
| 231735 | 9/1989 | Japan | 271/126 |
| 62343 | 3/1990 | Japan | 271/145 |

*Primary Examiner*—Robert P. Olszewski
*Assistant Examiner*—Steven M. Reiss
*Attorney, Agent, or Firm*—Finnegan, Henderson, Farabow, Garrett and Dunner

[57] ABSTRACT

An image recording apparatus using expendable supplies, the apparatus including a rotary portion of the paper tray for detecting the amount of expendable supplies which are available for use during image recording, a similar rotary portion of the document tray or an automated document feeder capable of counting sheets of paper for calculating the quantity of expendable supplies necessary for the selected recording operation, a comparator for comparing the detected amount with the calculated amount, and a display for informing an operator of the result of comparison.

5 Claims, 8 Drawing Sheets

IMAGE RECORDING APPARATUS WITH THE ABILITY TO DETERMINE IF ENOUGH EXPENDABLE SUPPLIES ARE AVAILABLE TO CARRY OUT A RECORDING JOB

BACKGROUND OF THE INVENTION

1. Field of the Invention

The present invention relates to an image recording apparatus, suitable for use in a digital copying machine, or the like, of the type in which an image of a document is read and stored, and in which the stored image information is recorded. The invention particularly relates to an image recording apparatus capable of judging, prior to execution of the recording operation instructed by an operator, as to whether there are or are not expendable supplies such as recording sheets, or the like, in the amount required for the chosen recording operation, and the invention further relates to an apparatus capable of preventing interruption of the recording operation because of a shortage of expendable supplies.

2. Discussion of the Related Art

Recently, with the spread of personal computers and word processors, etc., the types of image information to be copied, or likewise processed, has become diverse and large in quantity.

To cope with this phenomena, improvements in the quality of copied images has been necessary. Also, it has been necessary to increase flexibility and functions of copying machines over the traditional functions of number of copies and scale reduction/ enlargement.

Examples of the various functions which have been required in copying machines include electronic recirculating document handling (hereinafter abbreviated to "electronic RDH") in which a plurality of documents are copied a desired number of times for each document; and bookbinding in which images of a plurality of documents are suitably edited and copied in a manner so that images of two documents are copied on opposite ends of a sheet of recording paper so as to make a two page sheet, the sheets of recording paper on which images have been copied are stacked, and the stack is bound at the center and doubled into booklet in which the copies of the documents are arranged in the order of pages.

Other examples of functions which have been required in copying machines include image communication as in facsimile equipment, and printing for outputting information from a host computer, a personal computer, or the like.

Conventionally, copying machines in which the above-mentioned functions are available have been the so-called digital copying machines. In such a digital copying machine, documents are set in an automatic document feeder (hereinafter abbreviated to "ADF"), and the documents are automatically successively fed by the ADF onto a platen of the copying machine so that the image on each document is read by a scanner and stored in a storage device after it is converted into an electric signal.

Depending on the copying function designated by an operator, the image information of a document stored in the storage device is read out from the devise and converted into optical image information by a raster output scanner (hereinafter abbreviated to "ROS") unit so that image recording can be carried out through known electrophotographic copying processes.

During the electrophotographic copying process, at the time of image recording, expendable supplies such as recording sheets, toner, etc., stored in the copying machine are consumed. Accordingly, it is desirable to provide a digital copying machine with a function to detect and indicate existence of the expendable supplies.

If the copying machine is used as facsimile equipment, image information transmitted through a telephone line is stored in the storage device, and then the stored information is read out from the storage device and converted into an optical image by means of the ROS, or the like, so that image recording can be carried out through known electrophotographic copying processes.

On the other hand, when the above digital copying machine is used as a printer, image information transmitted from a host computer, or the like, is stored in the storage device, and then the information is read out from the storage device and converted into an optical image by the ROS, or the like, so that image recording can be carried by known electrophotographic copying processes.

In the copying machine discussed above there is the following problem. The prior-art digital copying machines have no function to detect and indicate the amount of expendable supplies such as recording sheets, toner, and the like, although they do have a function to detect and indicate the existence of expendable supplies such as recording sheets, toner, and the like.

Further, digital copying machines have, in addition to an ordinary document copying functions, various complicated functions such as an electronic RDH function in which a desired number of copies is made of plurality of documents and so on. Accordingly, it is it is difficult for an operator to estimate the amount of expendable supplies such as recording sheets, and the like, required for execution of a designated job based upon the number of sheets of documents and whether a function such as RDH or the like is to be executed. Sometimes, the expendable supplies, such as recording sheets, or the like, become used up during the copying operation. If the supplies are used up, the copying machine interrupts the copying operation and indicates the used-up state of the expendable supplies such as paper or toner, and thereby calls upon the operator to supplement the supplies. After the operator supplements the expendable supplies and pushes the start button again, the digital copying machine restarts the interrupted copying operation.

However, digital copying machines have complicated functions such as RDH, bookbinding, in addition to an ordinary document copying function. Accordingly, if sheets of recording paper, for example, become used up during the RDH function, the remainder portion of the job is restarted after additional recording paper is added. Therefore, the operator must examine the remaining number of pages of the documents for which the copying operation has been interrupted, and the remaining number of sheets of recording paper on which the copies are to be made so as to designate, on a control board, the number of pages of the documents, the number of sheets of recording paper, etc., on which the copying operation is restarted. Thus, the operation to start copying operation again after interruption of the copying operation is troublesome.

If the digital copying machine has the capability to act as facsimile equipment or a printer, there is sometimes a not-yet finished portion of a job stored in the storage device within the copying machine when an operator newly designates another job to be executed. In such a case, even if there is a sufficient quantity of expendable supplies such as sheets of recording paper, or the like, in the copying machine for execution of the job newly designated by the operator, the expendable supplies consumed by the not-yet finished job (for example, image recording for an incoming facsimile) so that the remaining quantity of the expendable supplies becomes inadequate to execute the job newly designated by the operator.

In this case, even if the quantity of expendable supplies such as sheets of recording paper, or the like, within the copying machine is examined, it is impossible to judge whether the newly designated job can be executed by the examined quantity of expendable supplies. Accordingly, in some cases, expendable supplies such as sheets of recording paper, or the like, may be used up in the copying operation so that the copying operation is interrupted. Also in this case, as described above, when copying operation is restarted after interruption of the copying operation, the operator is required to perform a complicated operation to examine the remaining number of pages of the documents, the remaining number of sheets of recording paper, etc., for which copying operation has been interrupted and to designate through control board the number of pages of the documents, the number of sheets of recording paper, etc., on which the copying operation be restarted. Thus, also in this case, the operation to start copying operation again after interruption is troublesome.

SUMMARY OF THE INVENTION

The present invention has been made in view of the above circumstances and has an object to provide an image recording apparatus in which, when a job is to be executed, the operator can confirm whether or not the expendable supplies are sufficient for execution of the job are available within the copying machine, thereby preventing the job from being interrupted because of a shortage of supplies.

Additional objects and advantages of the invention will be set forth in part in the description which follows and in part will be obvious from the description, of may be learned by practice of the invention. The objects and advantages of the invention may be realized an attained by means of the instrumentalities and combinations particularly pointed out in the appended claims.

To achieve the above object and in accordance with the purpose of the invention, as embodied and broadly described herein, the invention comprises an image recording apparatus using expendable supplies, the apparatus performing a selectable recording operation, the apparatus comprising means for detecting the amount of expendable supplies which are available for use during image recording, means for calculating the quantity of expendable supplies necessary for the selected recording operation, means for comparing the detected amount with the calculated amount, and means for informing an operator of the result of comparison.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENTS

Figure 1:
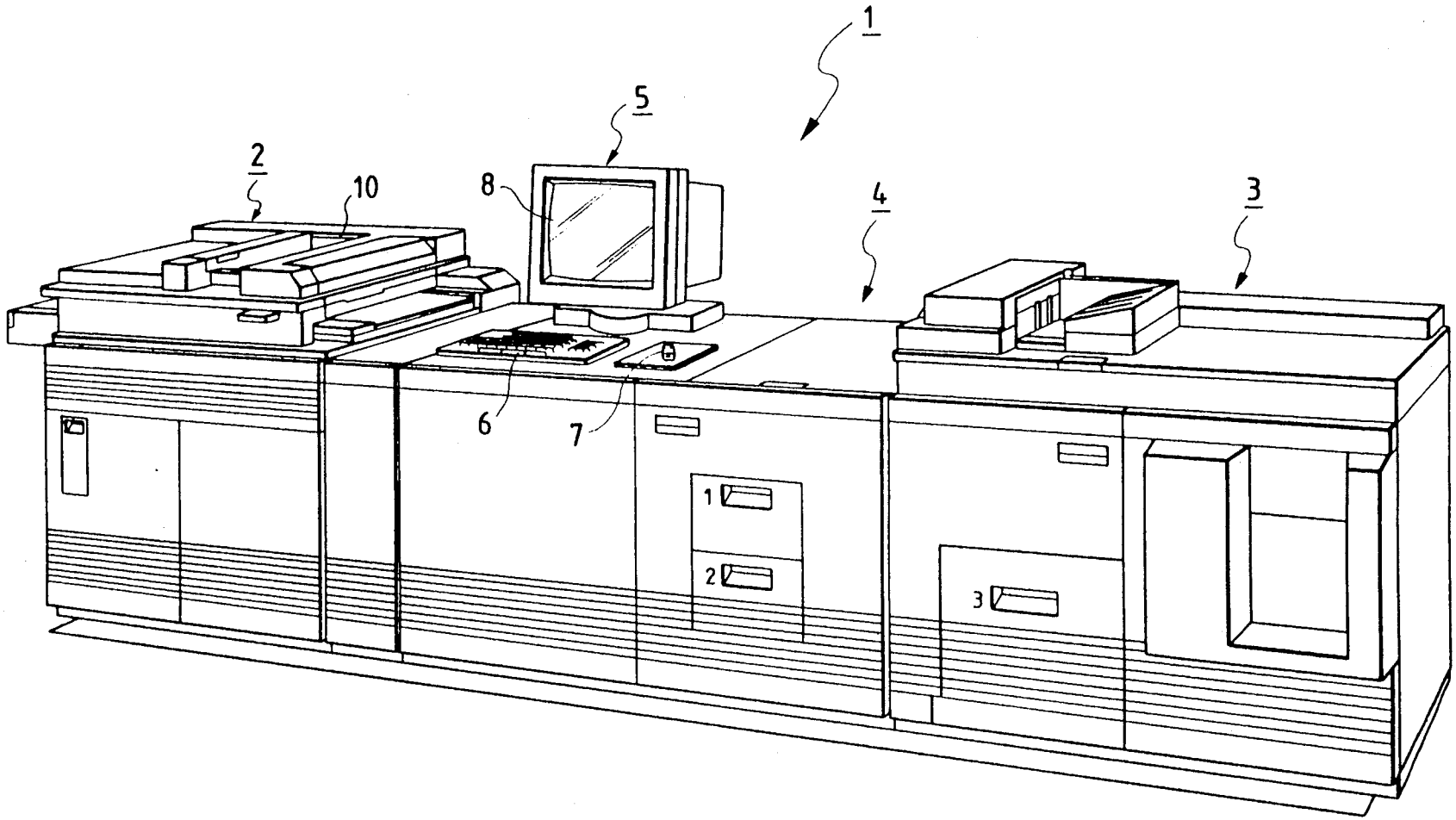
FIG. 1 is a perspective view showing the exterior of a digital copying machine which is an embodiment of the image recording apparatus according to the present invention.

Referring to the drawings, embodiments of the image recording apparatus according to the present invention will be described hereunder.

According to a first aspect of the present invention, the image recording apparatus in which an image of a document is read and converted into an electric signal so that, after the read image information of the document is stored, the image information is read out so as to record the image, the apparatus comprises an expendable supplies residue detection means for detecting a residue of expendable supplies which are consumed with the execution of image recording operation, and an information means for informing an operator of the residue of the expendable supplies detected by the expendable-supplies residue detection means.

Further, according to a second aspect of the present invention, the image recording apparatus in which an image of a document is read and converted into an electric signal so that, after the read image information of the document is stored, the image information is read out so as to record the image, the apparatus comprises an expendable-supplies residue detection means for detecting a residue of expendable supplies which are consumed with the execution of image recording operation, an expendable supplies consumption operation means for calculating a quantity of consumption of the expendable supplies necessary for execution of recording operation indicated by an operator, and an information means for comparing the residue of the expendable-supplies detected by the expendable-supplies residue detection means with the quantity of consumption of the expendable-supplies calculated by the expendable-supplies consumption operation means and for informing the operator of the result of comparison.

An image recording means used in either image recording apparatus has, for example, means in which the read image information is converted into optical image information by means of a ROS unit so that image recording is carried out through a known electrophotographic copying process. However, the present invention is not limited to this, because means for recording images by an electrostatic recording system, means for recording images by an ink jet recording system, or the like, may be used.

Expendable-supplies consumed with the image recording operation include sheets of recording paper on which image recording is carried out, toner by which development of an electrostatic latent image is carried out, and so on.

The above-mentioned expendable-supplies residue detection means has, for example, means for detecting the residue of sheets of recording paper, as expendable-supplies, accommodated in a paper supply cassette. However, the present invention is not limited to this but means for detecting the residue of toner accommodated in a developing device, means for detecting the residue of ink used in the ink jet recording system, or the like, may be used.

Further, as the above-mentioned expendable-supplies consumption operation means, for example, there is used means provided with means for detecting the thickness of documents arranged on a document feeding tray. Alternatively, as the above-mentioned expendable-supplies consumption operation means may be provided with means for detecting the number of sheets of read-in documents. Further alternatively, the above-mentioned expendable-supplies consumption operation means may have means in which an operation is performed so that, in the case where a recording operation in execution or a not-yet executed operation is present at a designated point of time, the calculation of expendable-supplies consumption is carried out by additionally summing up the expendable-supplies consumption necessary for the recording operation in execution or the not-yet executed operation.

According to the first aspect of the present invention, the residue of expendable-supplies which are consumed with the execution of the image recording operation is detected by the expendable-supplies residue detection means and the operator is informed, before the start of recording operations, by the information means of the detected residue of the expendable supplies. Thus, the operator can know the residue of the expendable supplies and can make a rough calculation of the expendable supplies to be consumed on the basis of the number of documents and the contents of recording operation which is to be carried out by the operator. Accordingly, by comparing the result of the above rough calculation with the residue of expendable supplies informed by the information means, the operator can make a judgment as to whether or not the expendable supplies necessary for execution of the recording operation to be carried out by the operator are present in the apparatus. Accordingly, the recording operation designated by the operator can be prevented from being interrupted because of shortage of the expendable supplies.

According to the second aspect of the present invention, the residue of expendable supplies which are consumed with the execution of image recording operation is detected by the expendable supplies residue detection means and the quantity of consumption of the expendable supplies necessary for execution of the recording operation designated by the operator is calculated by the expendable-supplies consumption operation means. The residue of expendable supplies detected by the expendable supplies residue detection means and the quantity of consumption of the expendable supplies calculated by the expendable-supplies consumption operation means are compared with each other by the information means so that the information means informs the operator of the result of comparison. Thus, the operator can easily make a judgment as to whether or not the expendable supplies necessary for execution of the recording operation to be carried out by the operator are present in the apparatus. Accordingly, the recording operation designated by the operator can be prevented from being interrupted because of shortage of the expendable supplies.

FIG. 1 is a perspective view showing the exterior of a digital copying machine which is an embodiment of the image recording apparatus according to the present invention. The digital copying machine is provided with, in addition to ordinary functions for making copies of documents, not only a function for performing copying on opposite surfaces and multiple copying on one-side surface, but an RDH function in which a plurality of documents are copied for desired number of sheets for every document under the condition of suitable assortment, a bookbinding function in which images of a plurality of documents are suitably edited and copied so that images of two documents are copied on each of opposite surfaces of a sheet of recording paper so as to divide each surface into two pages, the sheets of recording paper on which images have been copied are stacked, and the stacked sheets are bound at the center thereof and doubled into one booklet in which the copies of the documents are arranged in the order of pages.

Generally, the digital copying machine 1 is constituted by an image input terminal (hereinafter abbreviated to an "IIT") 2, an image output terminal (hereinafter abbreviated to an "IOT") 3, and a controller (hereinafter abbreviated to a "CONT") 4 for controlling the operation of the IIT 2 and IOT 3. The IIT 2 is arranged to read an image of a document, convert the read image into an electric signal, and output the electric signal after making fundamental processing such as zigzag correction, or the like, on the electric signal. The IOT 3 is arranged to store the image information supplied from the IIT 2, record the image information after making secondary processing according to demand, and output the image information.

The CONT 4 has a user interface (hereinafter abbreviated to a "UI") 5 through which an operator can designate copying operation, or the like. The UI 5 is provided with a keyboard 6 and a mouse 7 through which an operator can designate a copying operation, and a display 8 for displaying the contents of the copying operation designated by the operator.

In this embodiment, the IIT 2 is provided at its upper portion with an automatic document feeder (hereinafter abbreviated to an "ADF") 10 for automatically feeding a document onto a platen of the IIT 2.

Figure 2:
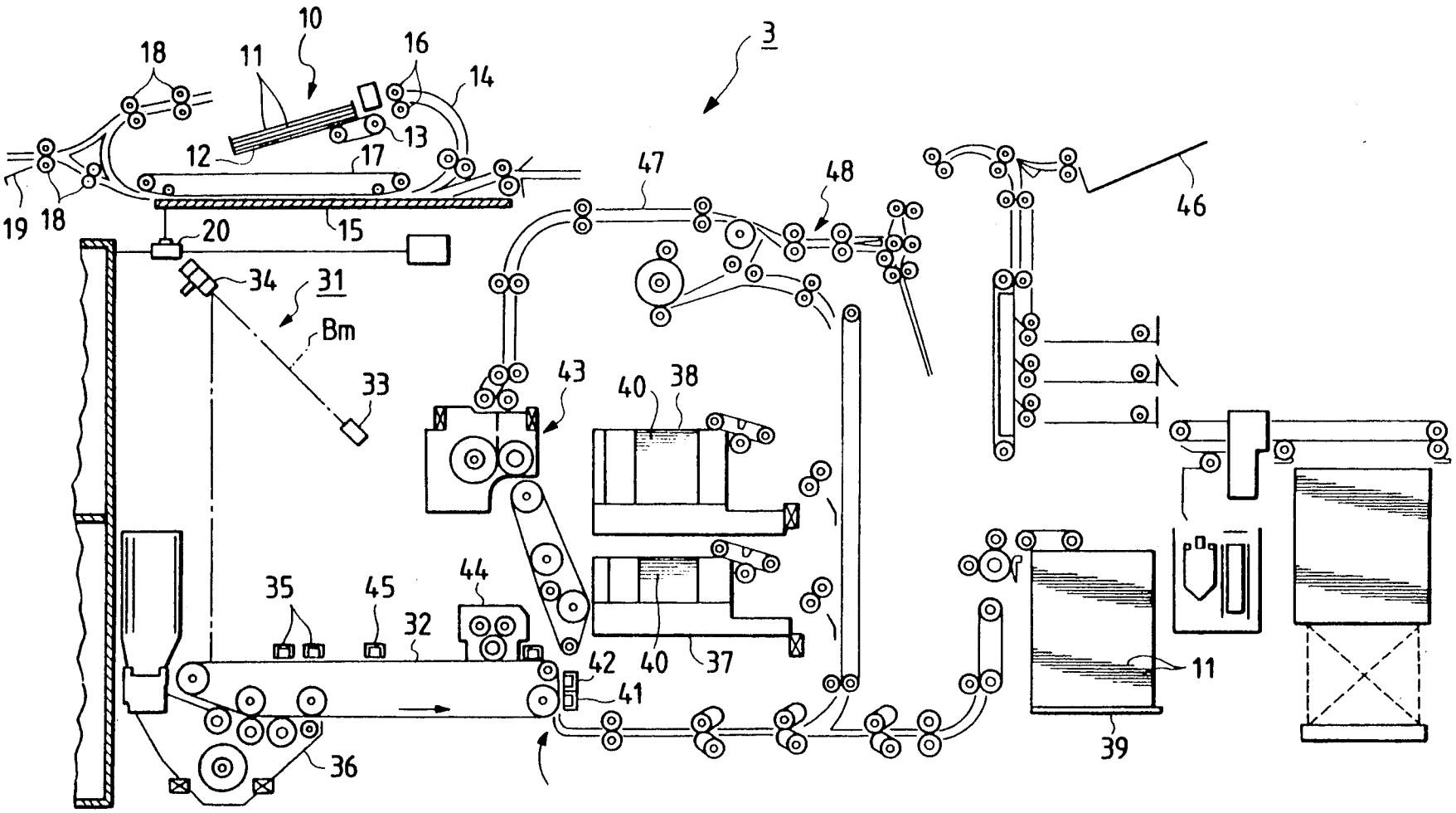
FIG. 2 is a view showing the configuration of the image recording section of the digital copying machine.
Figure 3:
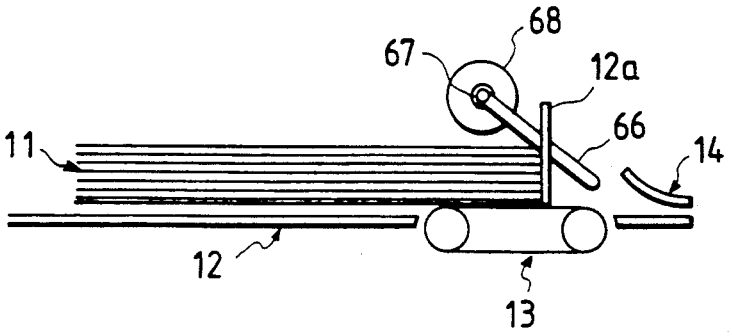
FIG. 3 is a view showing the configuration of main part of the ADF.

The ADF 10 is incorporated in a cover unit which openably covers the top of the platen of the IIT body as shown in FIG. 1. The ADF 10 includes, as shown in FIGS. 2 and 3, a document feed tray 12 for accommodating a large number of documents 11 therein in a state that the forward ends of the respective documents are made to abut against a side wall 12*a*, a feed belt 13 for feeding, one by one, the documents 11 accommodated in the document feed tray 12, conveyer rolls 16 for conveying the document 11, which is fed by the feed belt 13, to the platen 16 through a paper shoot 14, a conveyer belt 17 for conveying the document, which is conveyed by the conveyer rolls 16, to a document setting position on the platen 15, discharging conveyer rolls 18 for discharging the document 11 sent out by the conveyer belt 17 upon the completion of reading the image of the document 11 mounted on the platen 15, and a document receiving tray 19 for accommodating the discharged documents 11.

Figure 4:
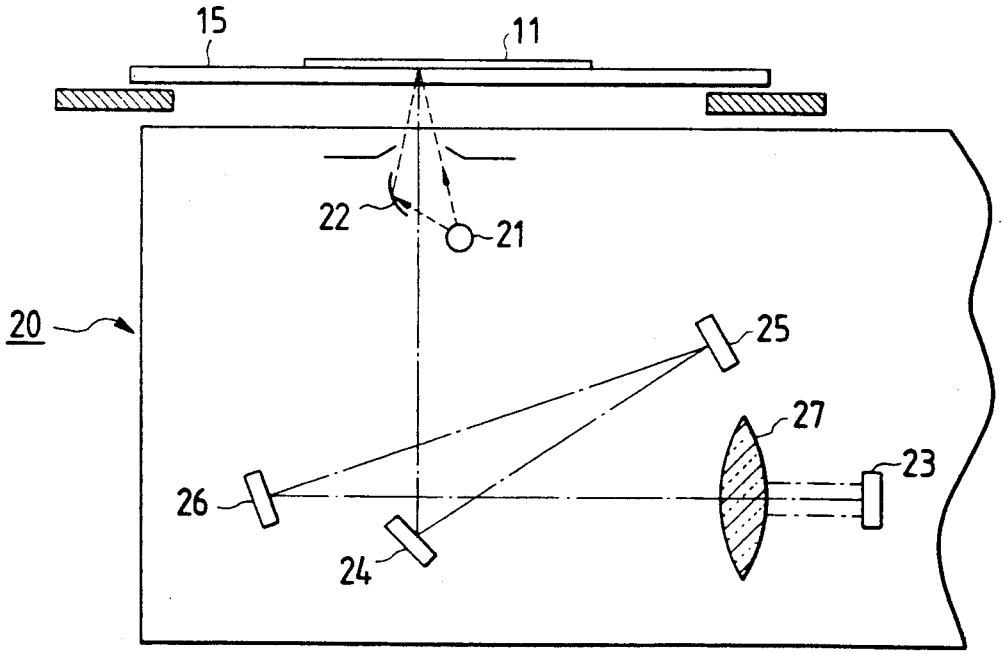
FIG. 4 is a view showing the configuration of the scanner.

The document 11 fed onto the platen 15 of the IIT body by the ADF 10 is read by a scanner 20 of the IIT 2 as shown in FIG. 4. The scanner 20 is provided with a light source 21 for illuminating the document 11 mounted on the platen 15, a reflection plate 22 for reflecting light from the light source 21 toward the document 1, a plurality of mirrors 24, 25, and 26 for leading the reflection light from the document 11 to an image sensor array 23 including Charge Couple Devices (CCDs), or the like, and a lens 27 for focusing the image carrying light directed by the mirrors 24, 25, and 26 onto the image sensor array 23. The light source 21, the mirrors 24, 25, and 26, the image sensor array 23, and the like, are integrally assembled as the scanner 20 (as shown in FIG. 2) and the scanner 20 is driven by a drive mechanism (not shown) so as to be reciprocally below the platen 15 in a sub-scanning direction. Further, the scanner 20 is arranged so as to read the image of the document 11 mounted on the platen 15 by means of the image sensor array 23 while moving below the platen 15 in the subscanning direction.

Figure 5:
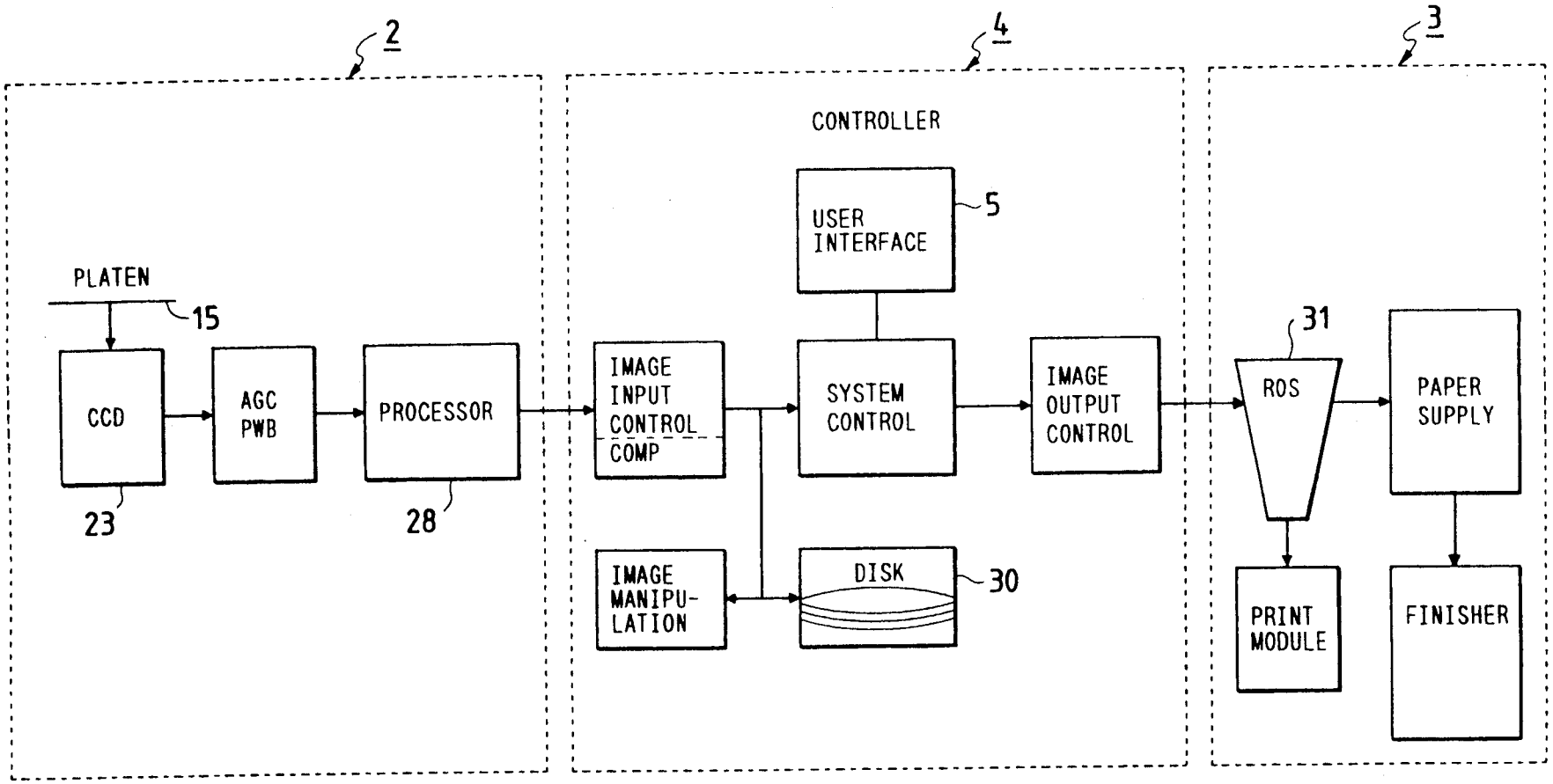
FIG. 5 is a block diagram showing the configuration of the IIT and IOT.

The image information of the document 11, read by the image sensor array 23 of the scanner 20, is supplied to a processor 28 so as to be subject to fundamental processing such as zigzag correction or the like, and then supplied to the IOT 3, as show in FIG. 5.

After being subject to secondary image processing in accordance with requirements, the image information received by the IOT 3 is stored in a storage device 30 including a hard disk, a semiconductor memory, or the like. The image information stored in the storage device 30 is read out from the storage device 30 in predetermined order on the basis of an instruction from the UI 5 provided in the CONT 4. The image information read out from the storage device 30 is converted into an optical signal which is supplied by a raster output scanner (hereinafter abbreviated to an "ROS") unit 31 onto a photoreceptor belt 32 through scanning exposure, as shown in FIG. 5.

The ROS unit 31 comprises a semiconductor laser 33 and a polygon mirror 34, as shown in FIG. 2, so that a beam from the semiconductor laser 33 is reflected by reflection surfaces of the polygon mirror 34 so as to be directed onto the photoreceptor belt 32 over a predetermined scanning range.

The ROS unit 31 is arranged so that a laser beam Bm emitted from the semiconductor laser 33, which oscillates in accordance with image information, is scanned by the polygon mirror 34 in the axial direction of the photoreceptor belt 32 so that an image corresponding to the image information is transferred onto the photoreceptor belt 32 through scanning exposure.

After the photoreceptor belt 32 is uniformly electrically charged in advance by primary chargers 36 so as to have a predetermined electrical potential, an image is applied onto the photoreceptor belt 32 by means of the ROS unit 31 through scanning exposure as described above, so that an electrostatic latent image is formed on the surface of the photoreceptor belt 32.

The electrostatic latent image is developed to form a toner image by a developing device 36 using black toner. Then, the toner image formed on the photoreceptor belt 32 is transferred, by electrification of a transfer charger 41, from the photoreceptor belt 32 onto recording paper 40 of a predetermined size supplied from one of a plurality of paper supply cassettes 37, 38 provided in the IOT body. More than two paper cassettes may be provided. The recording paper 40 on which the toner image has been transferred is separated from the photoreceptor belt 32 by a separation charger 42 using electrification, and conveyed to a fusing device so that the toner image is fused and fixed on the recording paper 40.

After the completion of the transfer step, the surface of the photoreceptor belt 32 is cleaned by a cleaner 44 so that residual toner, paper powder, and the like are removed, and the surface of the photoreceptor belt 32 is electrified by a static eliminator 45 so that residual charge thereon is eliminated. Thus, the photoreceptor belt 32 is made ready for the next image recording process.

The recording paper 40 on which the toner image has been fused as described above is discharged as-is onto a discharge tray 46 in the case of a normal copy mode.

In the case of a double-side copy mode, a one-side multiple copy mode, or the like, on the contrary, the recording paper 40 on which the toner image has been fused is not discharged as-is, but conveyed to the transfer section again through a convey path 47 and a paper turn-over mechanism 48 in the state where the recording paper 40 is left as-is or the front and rear surfaces of the recording paper 40 are turned over, so that a predetermined toner image is transferred and fused. After repetition of such transferring and fusing of predetermined images, the recording paper 40 is discharged for the first time onto the discharge tray 46.

Figure 6:
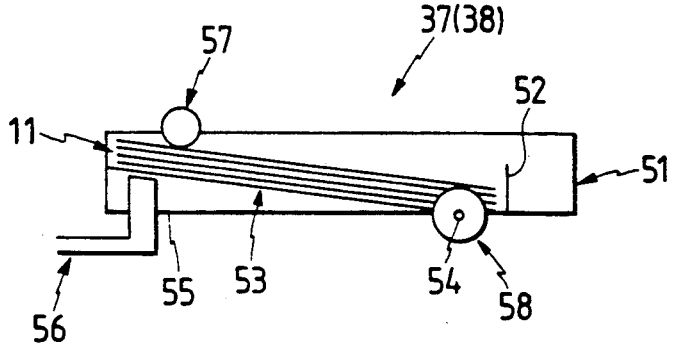
FIG. 6 is a view showing the configuration of the paper supply cassette.

In this embodiment, there is provided means for detecting the amount (residue) of expendable supplies which are available for recording. As embodied herein, the recording paper residue detection means is provided in each of the paper supply cassettes 37, 38. As shown in FIG. 6, each of the paper supply cassettes 37 and 38 has a paper supply cassette body 51 which is opened at its upper end surface and is shaped so as to be like a relatively thin box. The sheets of recording paper 40 having a predetermined size are accommodated in the paper supply cassette body 51 in the state in which they are stacked one up on one. A side plate 52, on which the rear ends of the respective sheets of recording paper 40 are abutted is provided in the upright state inside the paper sup ply cassette body 51. Further, the paper cassette includes means for sensing the thickness of the paper in the cassette, the means herein embodied as a bottom plate 53 on which the sheets of recording paper 40 are placed is provided on the bottom portion of the paper supply cassette body 51. The bottom plate 53 is rotatable about a rotary shaft 54 integrally provided with the rear end of the bottom plate 53. The bottom plate 53 is urged upward by an arm 56 penetrating an opening portion 55 formed in the bottom portion of the paper supply cassette body 61. The uppermost one of the sheets of recording paper 40 stacked on the bottom plate 53 is always pressed against a feed roller 57.

Further, a rotary encoder 58 is attached to the rotary shaft 54 of the bottom plate 63 provided on the bottom portion of the paper supply cassette body 51. The tilt angle of the bottom plate 53 can be detected by the rotary encoder 58.

That is, the rotary shaft 54 of the bottom plate 53 is integrally provided with the bottom plate 53 to thereby rotate together with the bottom plate 53 the tilt angle which changes in accordance with the residue of the sheets of recording paper 40. The rotary encoder 58 is mounted on the rotary shaft 54 at its end portion.

Figure 7:
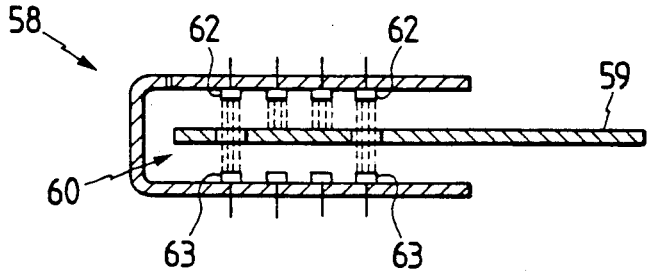
FIGS. 7 and 8 are a section and a plan showing the rotary encoder.
Figure 8:
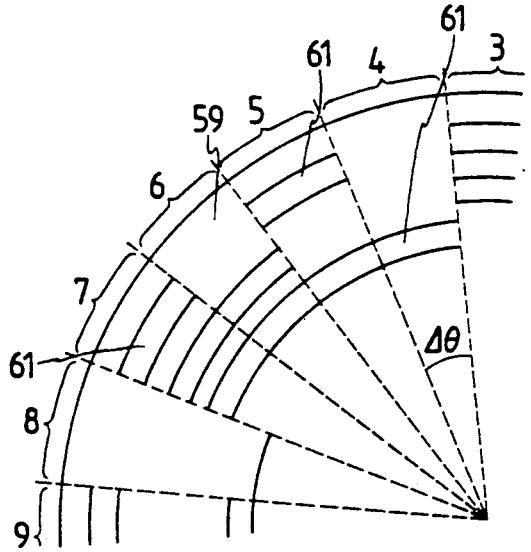

As shown in FIG. 7, the rotary encoder 58 includes a rotary disk 59 fixed to the rotary shaft 54 and a photo sensor 60 provided so as to sandwich the rotary disk 59. As shown in FIG. 8, slits 61 corresponding to binary codes, which are different at every predetermined angle $\Delta\theta$, are circumferentially formed in the rotary disk 59 at its outer circumference. The photo sensor 60 comprises plural pairs (four pairs in the drawing) of luminous elements 62 and light detection elements 63 provided so as to be in opposition to each other through the slits 61, of the rotary disk 59. When the rotary disk 59 rotates in accordance with the tilt angle of the bottom plate 53, the existence of the slits 61, provided in the rotary disk 59 is detected by the photo sensor 60, so that the tilt angle of the rotary disk 59 is detected in the form of a binary-coded electric signal.

The tilt angle of the bottom plate 53 of each of the paper supply cassettes 37 and 38 changes in accordance with the thickness, that is, the residue, of the sheets of recording paper 40 remaining in each of the paper supply cassettes 37 and 38 and the tilt angle of the bottom plate 53 is detected as an output signal of the rotary encoder 68, so that the residue of the recording paper 40 can be detected.

Further. in this embodiment, there is provided means for calculating the quantity of expendable supplies necessary for execution of the selected recording operation. As embodied herein, the calculating means is provided with means for detecting the number of documents. The document number detection mean 65 is provided in the ADF 5. As shown in FIG. 3, the ADF 5 is provided with the document feed tray 12 for accommodating lots of documents 11 in a state in which the forward ends of the respective documents 11 abut against the side wall 12*a*. The document feed tray includes means for sensing the thickness of the paper in the cassette, the means herein embodied as arm 66 provided inside the side wall 12*a* of the document feed tray 12 so as to abut the top end of the documents 11 accommodated in the document feed tray 12. The arm 66 is attached so as to be rotatable about a rotary shaft 67 and urged by a spring (not shown) in the direction shown by an arrow. When the documents 11 are accommodated in the document feed tray 12 in the state in which the forward ends of the respective documents 11 abut against the side wall 12*a*, the arm 66 is pressed upward by the upper end of the documents 11 so as to rotate counterclockwise in FIG. 3.

A rotary encoder 68 is mounted on the rotary shaft 67 of the arm 66 provided in the document feed tray 12 of the ADF 5. The tilt angle of the arm 66 can be detected by the rotary encoder 68.

The rotary encoder 68 is configured similarly to the rotary encoder 58 of the recording paper residue detection means shown in FIGS. 7 and 8.

Accordingly, the tilt angle of the arm 66 of the ADF 5 changes in accordance with the thickness, that is, the number of sheets, of the documents 11 set in the document feed tray 12 of the ADF 5, and the tilt angle of the arm 66 is detected as an output signal of the rotary encoder 68, so that the number of sheets of the documents 11 can be detected.

Further, in this embodiment, there is means for calculating the quantity of expendable supplies necessary for execution of the selected recording operation on the basis of the residue of the sheets of recording paper detected by the recording paper residue detection means 50 as described above and the recording operation designated by the operator through the UI 5, and means for comparing the detected amount with the calculated amount and means for informing the operator of the result of the comparison. The calculating means, comparison means, and informing means are configured so as to be realized by a control circuit of the digital copying machine.

Figure 9:
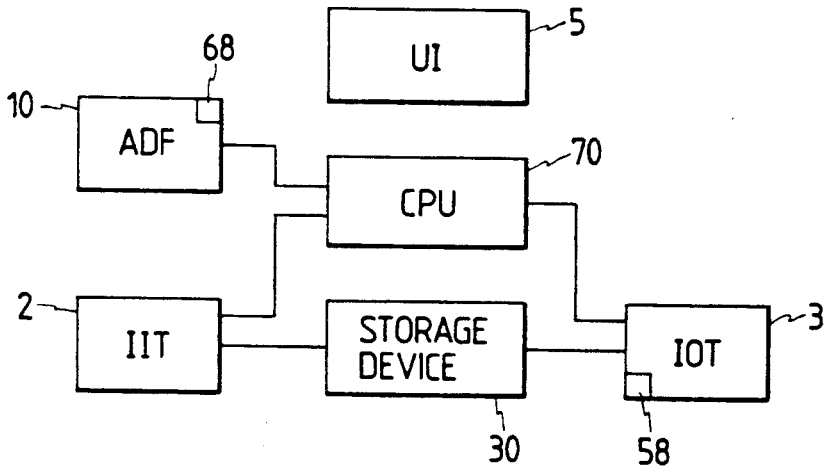
FIG. 9 is a block diagram showing the control circuit of a digital copying machine according to the invention.

FIG. 9 is a block diagram showing the control circuit of the digital copying machine. In the drawing, the control circuit comprises the IIT 2 for reading out an image of the document 11, for converting the read image into an electric signal, for executing basic processing such as zigzag correction, or the like, on the image information converted into the electric signal, and for producing the processed electric signal, the IOT 3 for temporarily storing the image information sent from the IIT 2, for recording the image after making secondary processing onto the image information in case of need, and for outputting the image information, a CPU 70 provided in the CONT 4 so as to control the operation of the IIT 2 and the IOT 3 and having a part of the functions of the expendable-supplies consumption operation means and the information means, the UI 5 through which a user designates a desired recording operation, the storage device 30 for temporarily storing the image information sent from the IIT 2, the ADF 10 for automatically conveying the documents 11 onto the platen 15 of the IIT 2, the rotary encoder 68 of the document number detection means 65 provided in the ADF 10, and the rotary encoder 50 of the recording paper residue detection means provided in the IOT 3.

In a digital copying apparatus according to this embodiment having such a configuration as described above, the residual quality of expendable supplies is detected and the operation is controlled on the basis of the detection in such a manner as follows. An operator sets the documents 11 to be copied on the document feed tray 12 of the ADF 10 and simultaneously designates the kind of copying operation (job) by use of the keyboard of the UI 5 or the like, and then starts the copying operation.

Figure 10:
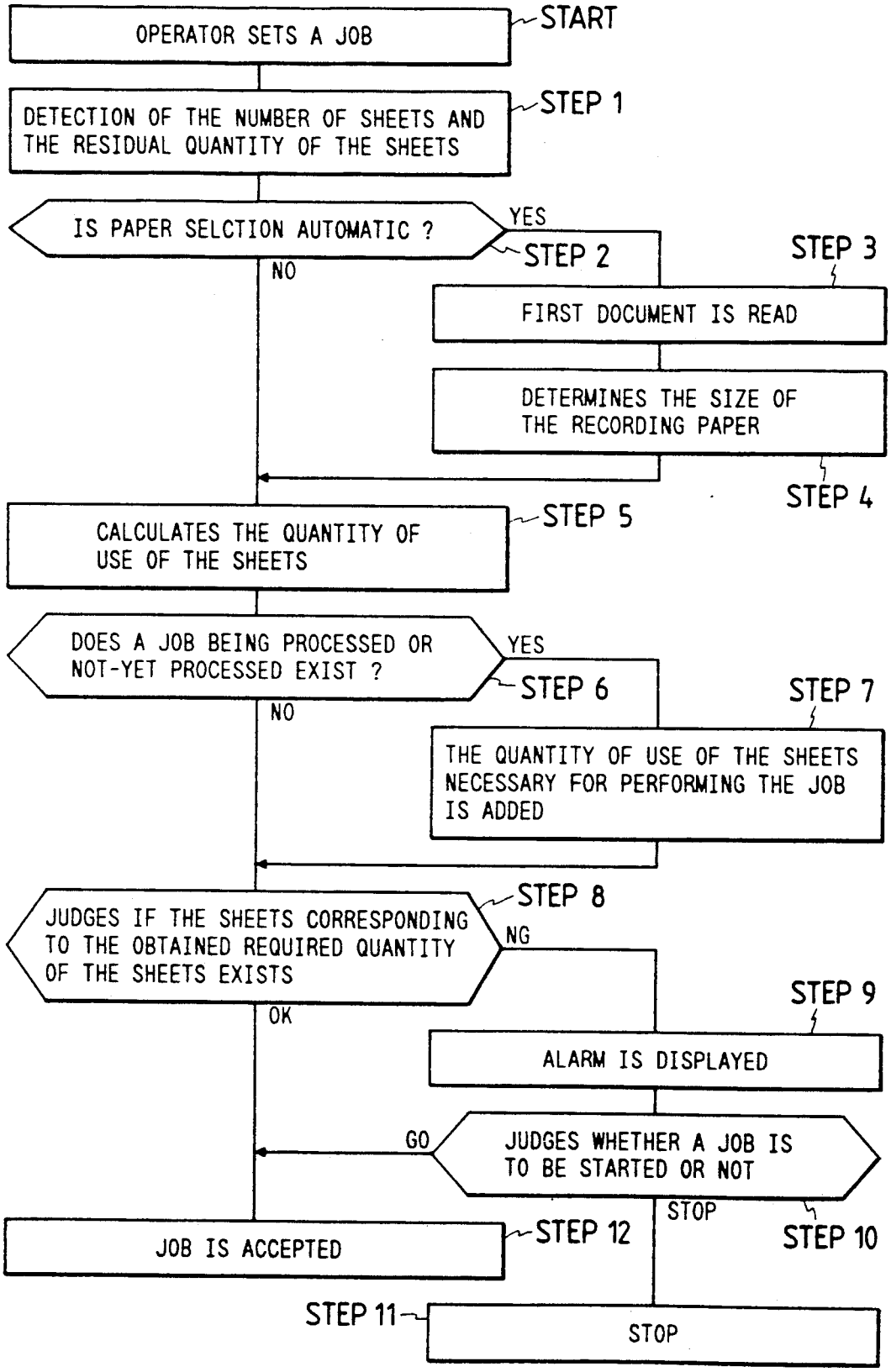
FIG. 10 is a flow chart showing the operation of the control circuit.

When the operator has set the documents 11 to be copied on the document feed tray 12 of the ADF 10, designated the kind of recording operation (job) to be performed through the keyboard 6 of the UI 5, or the like, and pressed a start button, the CPU 70 detects the number of sheets of the documents to be copied by means of the rotary encoder 68 of the document number detection means 65 and simultaneously detects the residual quantity of the sheets of recording paper in each of the paper supply cassettes 37 and 38 by means of the rotary encoder 58 of the recording paper residue detection means 50 as shown in FIG. 10 (Step 1).

The CPU 70 then judges whether paper selection is automatic or not (Step 2). In the case where the automatic paper selection is designated by an operator by use of the UI 5, the CPU 70 drives the ADF 10 so that the first document is read (Step 3), and detects the size of the document 11 to thereby automatically determine the size of the recording paper 40 on the basis of the copy magnification or scale designated from the UI 5 (Step 4).

After the size of the recording paper 40 is thus determined, or in the case where the operator designates the size of the recording paper 40 for himself/herself without designating automatic paper selection, the CPU 70 calculates the quantity of use of the sheets of recording paper 40 having the determined or selected predetermined size (Step 5). The calculation of the quantity of use of the sheets of recording paper 40 is performed by multiplying the number of sheets of the documents 11 detected by the document number detection means 65 by the number of copy sheets designated by the UI 5. At this time, in the case where a bookbinding function or the like is designated, the quantity of sheets of recording paper 40 to be used is calculated in accordance with the bookbinding function, or the like.

Next, the CPU 70 judges whether or not a job is being processed or a not-yet processed job exists (Step 6). In the case where a job is being processed or not-yet processed job exists, the quantity of use of the sheets of recording paper 40 necessary for performing the job being processes or not-yet processed is added (Step 7).

After the quantity use of the sheets of recording paper 40 necessary for use in the job being processed or the not-yet processed job is thus added, or in the case where no job is being processed or no not-yet processed job exists, a judgment is made as to whether the sheets of recording paper 40 corresponding to the obtained required quantity of the sheets of recording paper 40 exists in each of the paper supply cassettes 37 and 38 of the IOT 3 or not on the basis of the signal supplied from the recording paper residue detection means 50 (Step 8).

In the case where the sheets of recording paper 40 existing in the paper supply cassettes 37 and 38 of the IOT 3 are not sufficient when compared to the required quantity of sheets of recording paper 40 obtained in the manner described above, an alarm is displayed on the display 8 of the UI 5 so as to inform the operator of the existing condition (Step 9). The operator judges whether a job is to be started or not (Step 10). When the operator selects stoppage of the job, the operator stops the copying operation (Step 11).

On the other hand, when the sheets of recording paper 40 is sufficient when compared to the required quantity of sheets of recording paper 40, or when the operator selects start of the job, acceptance of the job, the job is accepted (Step 12) to thereby start the copying operation in accordance with the job designate by the operator.

Thus, the recording paper residue detection means 50 detects the residual quantity of the sheets of recording paper 40 consumed by image recording operation, and CPU 70 calculates the quantity of consumption of the sheets of recording paper 40 necessary for execution of the recording operation designated by the operator. The CPU 70 compares the residual quantity of the sheets of recording paper 40 detected by the recording paper residue detection means 50 and the quantity of consumption of the sheets of recording paper 40 calculated by the CPU 70, and the display 8 of the UI 5 displayed thereon the result of comparison, so that the operator is informed of the result before starting of the recording operation. Accordingly, while looking at the display 8 of the UI 5, the operator can easily judge whether or not the sheets of recording paper 40 necessary for the recording operation to be carried out exist in the apparatus, so that the operator can prevent the recording operation designated by himself/herself from being interrupted because of shortage of the expendable supplies.

Figure 11:
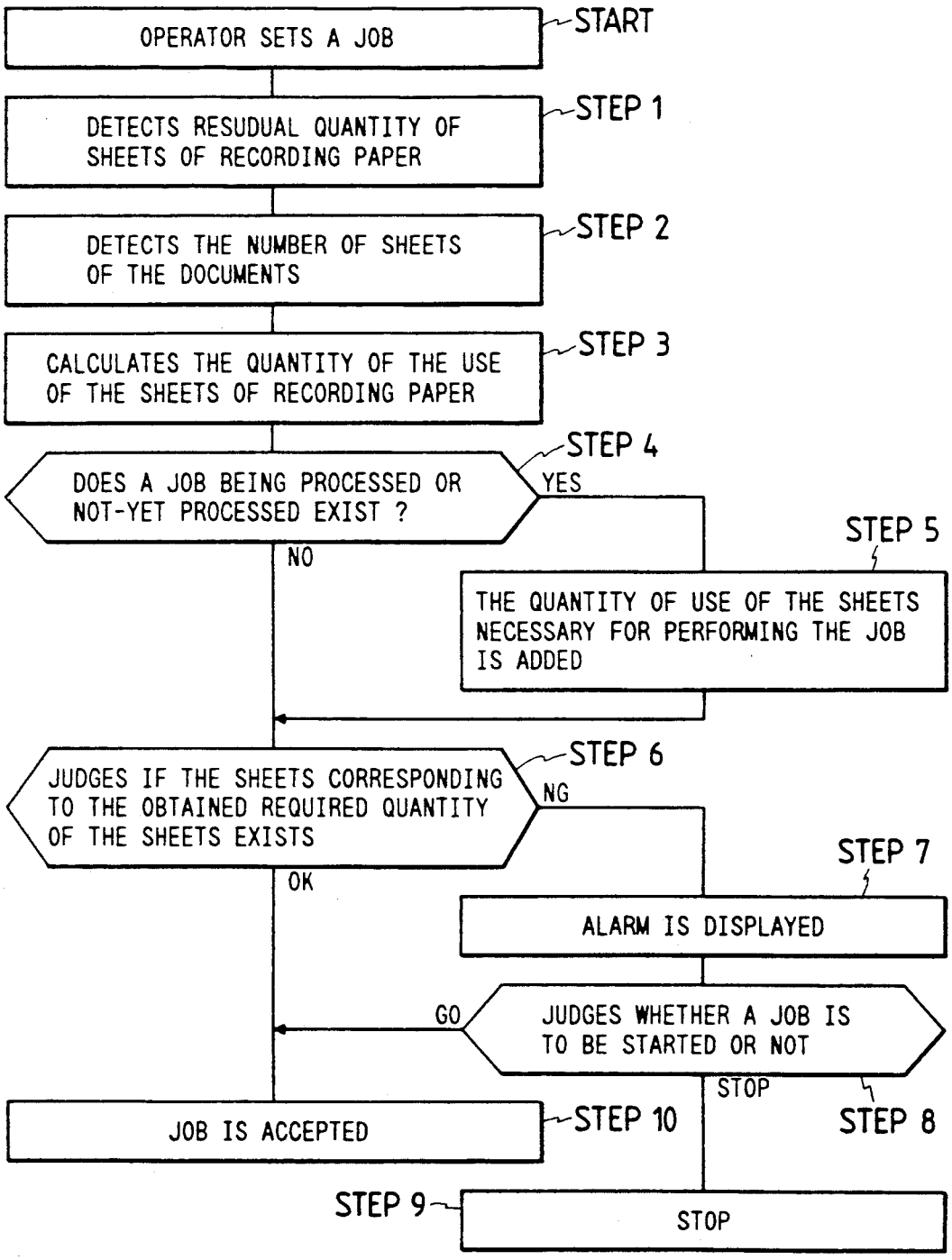
FIG. 11 is a flow chart showing another embodiment of the present invention.

FIG. 11 shows another embodiment of the present invention, in which the same portions of the apparatus as those in the above embodiment are correspondingly referenced. In this embodiment, a job is started after images of documents 11 have been read previously without detecting the number of sheets of the documents 11 in the state in which the documents 11 are set in the ADF 10. That is, in this embodiment, as shown in FIG. 11, an operator sets the documents 11 to be copied onto the document feed tray 12 of the ADF 10, designates the kind of copying operation or job through the key board 6 of the UI 5 or the like, and operates the start button. Then, the CPU 70 detects the residual quantity of the sheets of recording paper 40 in each of the paper supply cassettes 37 and 38 on the basis of the signal produced from the rotary encoder 58 of the recording paper residue detection means 50 (Step 1).

Then, the CPU 70 actuates the ADF 10 to start reading of the documents 11, and the CPU 70 detects the number of sheets of the documents 11 by counting the number of sheets of the documents 11 read by the ADF 10 (Step 2).

Next, the CPU 70 calculates the quantity of use of the sheets of recording paper 40 having a predetermined size and read by the ADF 10 (Step 3). The calculation of the quantity of use of the sheets of recording paper 40 is performed by multiplying the number of the sheets of documents 11 detected by the ADF 10 by the number of sheets of copies designated by the UI 5. At that time, in the case where a bookbinding function, or the like, is designated, the quantity of use of the sheets of recording paper 40 corresponding to the bookbinding function, or the like is, calculated.

Next, the CPU 70 makes a judgment as to whether any job is being processed or any not-yet processed job exists (Step 4). If a job is being processed or a not-yet processed job exists, the quantity of use of the sheets of recording paper 40 necessary for performing the job be processed or the not-yet processed job is added (Step 5).

Thus, after the quantity of use of the sheets of recording paper 40 necessary for the job being processed or not-yet processed is added, or in the case where no job exists, a judgment is made as to whether or not the number of the sheets of recording paper 40 in the paper supply cassettes 37 and 38 of the IOT 3 insufficient when compared to the required quantity of use of the sheets of recording paper 40 calculated as described above, on the basis of the signal produced from the recording paper residue detection means 50 (Step 6).

If the number of sheets of recording paper 40 in the paper supply cassettes 37 and 38 of the IOT 3 is insufficient when compared to the required quantity of the sheets of recording paper 40 obtained by calculation, an alarm is displayed on the display 8 so as to inform the operator of the existing condition (Step 7). The operator makes a judgment whether the job is started or not (Step 8), and if the operator selects to stop the job, the operator stops the copying operation (Step 9).

On the other hand, if the number of the sheets of recording paper 40 in the paper supply cassettes 37 and 38 of the IOT 3 is sufficient when compared to the required quantity of the sheets of recording paper 40 obtained by calculation, or if the operator selects to start the job, the job is accepted (Step 10) and the copying operation corresponding to the job designated by the operator is began.

Thus, in the case where the apparatus is arranged so that the number of sheets of the documents 11 is previously read and detected by the ADF 10, it is not necessary to provide document number detection means 65 in the ADF 10. Accordingly, the configuration of the apparatus can be simplified, resulting in reduction in cost.

Although the case in which an alarm is displayed on the display 8 of the UI 5 as the informing means has been described in the above embodiments, the present invention is not limited to this, but any means (for example) means for informing the operator of shortage of the sheets of recording paper with sound, means for informing the operator of shortage of the sheets of recording paper by actively inhibiting the operation of the apparatus, or the like may be used as the informing means.

The present invention is constituted by the above configuration and operation, so that an operator can make confirmation as to whether expendable supplies sufficient to perform the job designated by the operator are available inside the apparatus. Thus, it is possible to provide an image recording apparatus in which the job designated by the operator is prevented from being interrupted because of a shortage of the expendable supplies.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image recording apparatus which uses expendable supplies, the apparatus for performing a selectable image recording operation, the apparatus comprising:

an automated document feeder capable of automatically feeding individual sheets of original documents;

means for detecting the amount of expendable supplies which are available for use during image recording;

means for calculating the quantity of expandable supplies necessary for the selected image recording operation, the calculating means including means associated with the automatic document feeder for counting the sheets as they are fed;

means for comparing the detected amount with the calculated amount; and means for informing the operator of the result of the comparison.

2. An image recording apparatus which uses expendable supplies, the apparatus for performing a selectable image recording operation, the apparatus comprising:

at least one paper feed cassette for storing a stack of sheets of recording paper;

a document feed tray into which a stack of document papers having images to be recorded are placed;

means for detecting the amount of recording paper available during image recording, the detecting means including means associated with the cassette for sensing the thickness of the stack of recording paper stored in the paper feed cassette;

means for calculating the quantity of recording paper necessary for the selected image recording operation, the calculating means including means associated with the document feed tray for sensing the thickness of the stack of document papers disposed in the document feed tray;

means for comparing the detected amount with the calculated amount; and means for informing an operator of the result of the comparison, wherein the sensing means of the detecting means comprises:

a paper holding portion rotatable about a shaft, the amount of rotation depending upon the thickness of the stack of paper held in the paper holding portion; and a rotary encoder for sensing the amount of rotation.

3. The apparatus of claim 2 wherein the sensing means of the calculating means comprises:

a paper holding portion rotatable about a shaft, the amount of rotation depending upon the thickness of the stack of paper held in the paper holding portion; and a rotary encoder for sensing the amount of rotation.

4. The image recording apparatus as claimed in claim 2, wherein the rotary encoder comprises:

a rotary disc rotatable with the paper holding portion, the rotary disc having different patterns of slits formed in differing angular sections of the disc;

a light source on one side of the disc; and a photoreceptor on the side of the disc opposite the light source.

5. The image recording apparatus as claimed in claim 3, wherein the rotary encoder comprises:

a rotary disc rotatable with the paper holding portion, the rotary disc having different patterns of slits formed in differing angular sections of the disc;

a light source on one side of the disc; and a photoreceptor on the side of the disc opposite the light source.

* * * * *

UNITED STATES PATENT AND TRADEMARK OFFICE

CERTIFICATE OF CORRECTION

PATENT NO. : 5,096,180

DATED : March 17, 1992

INVENTOR(S) : Daiji Nagaoka et al.

It is certified that error appears in the above-identified patent and that said Letters Patent is hereby corrected as shown below:

Claim 1, column 13, line 45, change "expandable" to --expendable--.

Signed and Sealed this

Twenty-eighth Day of September, 1993

Bruce Lehman

*Attest:*

BRUCE LEHMAN

*Attesting Officer*

*Commissioner of Patents and Trademarks*